United States Patent [19]

Herold et al.

[11] Patent Number: 4,464,941

[45] Date of Patent: Aug. 14, 1984

[54] DEVICE FOR THE CONTACTLESS METERING OF LIQUIDS

[75] Inventors: Wolf-Dietrich Herold, Hechendorf; Oswald Gasser; Günter Pieper, both of Seefeld, all of Fed. Rep. of Germany

[73] Assignee: ESPE Fabrik pharmazeutischer Praeparate GmbH, Seefeld, Fed. Rep. of Germany

[21] Appl. No.: 474,262

[22] Filed: Mar. 11, 1983

[30] Foreign Application Priority Data

Apr. 2, 1982 [DE] Fed. Rep. of Germany ..... 3212378

[51] Int. Cl.[3] ..... B01L 3/02

[52] U.S. Cl. ..... 73/864.13; 222/386

[58] Field of Search ..... 73/864.13, 864.16, 864.17, 73/864.18; 422/100; 222/309, 386

[56] References Cited

U.S. PATENT DOCUMENTS

| | | | |
|---|---|---|---|
| 2,792,834 | 5/1957 | Kapelsohn | 73/864.16 |
| 3,232,117 | 2/1966 | Gilmont | 73/864.13 |
| 3,730,389 | 5/1973 | Harris, Sr. et al. | 222/386 |

FOREIGN PATENT DOCUMENTS

| | | | |
|---|---|---|---|
| 2709583 | 9/1977 | Fed. Rep. of Germany | 73/864.16 |
| 2021971 | 12/1979 | United Kingdom | 422/100 |

*Primary Examiner*—S. Clement Swisher

*Attorney, Agent, or Firm*—Barnes & Thornburg

[57] ABSTRACT

A device for the non-contacting dosing or metering of liquids, designed as a dosing syringe, comprises a piston centrally disposed within a sleeve, with a spring surrounding the piston. The spring bears against an upper end of a barrel within which the piston reciprocates and which is surrounded by the lower end of the sleeve. The outside of the barrel is formed with stroke-limiting abutments.

9 Claims, 3 Drawing Figures

DEVICE FOR THE CONTACTLESS METERING OF LIQUIDS

DESCRIPTION

Figure 1:
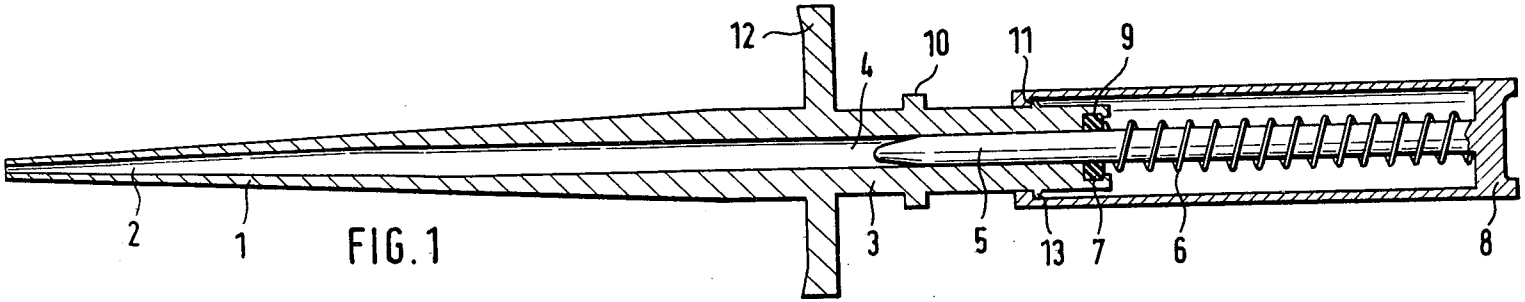

This invention relates to a device for the contactless metering of liquids.

Devices of this type, also called "dosing syringes", are known for instance, from German patent specification No. 1,090,449 and German Auslegeschrift No. 1,291,142, in which a piston disposed within a hollow barrel is advanced against the action of a spring and the liquid is drawn up by the return movement of the piston into the initial position thereof due to the action of the spring. The liquid is drawn up in a non-contacting manner, which means that the liquid will not contact the piston and will only reach a level that is lower than the point where the movement of the piston terminates. The movement of the piston is limited by abutments, such that upon each actuation a fixed predetermined volume of liquid will be drawn up. As compared to other dosing syringes in which the syringe piston is manually drawn up and the amount of liquid drawn up is read with the aid of graduation marks provided on the outside of the syringe body, such dosing devices offer considerable advantages, because reading errors such as, for instance, parallax reading errors, cannot occur. However, the known devices consist of a great number of parts so that assembly thereof is time-consuming and production costs are correspondingly high. Furthermore, with the known devices the metered quantity that is aspirated upon each single actuation cannot be varied.

It is therefore the object of the present invention to provide a device for the contactless metering of fixed quantities of liquids, in which the number of parts is minimized and which permits a variation of the metered quantity by replacement of one single part.

In view of this object, the present invention provides a device for the contactless metering of liquids, which comprises

- an elongate body having a longitudinal passage therethrough, an upper portion of the body forming a hollow barrel the interior of which forms an extension of said passage,
- a sleeve having an open lower end engaging the outer surface of said barrel,
- a piston centrally disposed within said sleeve and mounted for reciprocation inside said barrel,
- a spring surrounding said piston and bearing against an upper end of said barrel to bias said piston towards one limit position, and
- means providing a sealing between said upper barrel and said piston.

This device thus includes a syringe-shaped body having a hollow barrel at the upper end thereof. A passage starts from this hollow barrel and exits into the needle-like forward end of the body. The upper end of the hollow barrel is sealed by a sealing element of elastic material. A piston is fitted through this sealing element into the hollow barrel, said piston being axially movable between two positions, which are fixed by abutments disposed on the outside of the body. The piston is centrally mounted inside a sleeve which overlaps the hollow barrel. A spring is fitted onto the piston and is supported at the bottom of the sleeve as well as at the upper end of the hollow barrel. When the piston is pushed into the hollow barrel the spring will be compressed so that when the piston is released the sleeve together with the piston will be returned to the starting position which is determined by an abutment. The advance movement of the piston is also limited by an abutment.

Preferably, the piston and the sleeve are integrally formed so that the device according to the invention consists of a total of only four parts, viz., the syringe-like body, the sealing element disposed at the upper end of said body, the part comprised of sleeve and piston, and the spring fitted onto the piston.

The sealing element for sealing the hollow barrel is made of elastic material and is so designed that it is seated on the piston with a pressure acting in radial direction. It is thereby possible to exchange the part comprised of sleeve and piston for another one whose piston has a different diameter. The elasticity of the sealing member suffices to hermetically seal the piston even when the diameter thereof is reduced. The reduction of the piston diameter results in a reduction of the metered quantity, since a lesser volume will be diplaced when such a piston is pushed into the hollow barrel.

In a preferred embodiment of the invention that end of the sleeve which is pushed over the hollow barrel is formed with two longitudinally extending slots, such that the lower end of the sleeve may be resiliently spread apart and pushed over the abutments formed on the outside of the hollow barrel.

Figure 2:
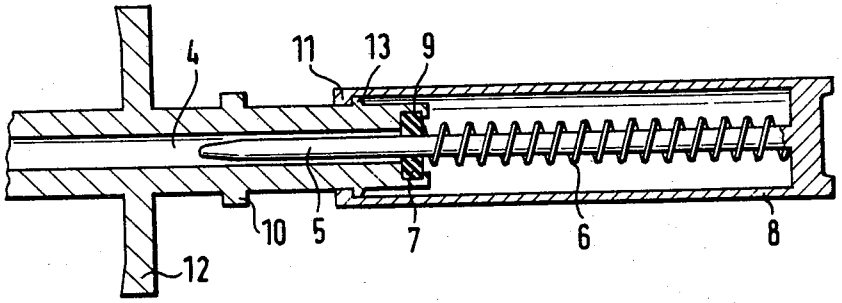

Embodiments of the invention will be described in detail with reference to the accompanying drawings, in which:

FIG. 1 a schematic cross-section through a device according to the invention;

FIG. 2 an alternative embodiment of the device according to FIG. 1, and

Figure 3:
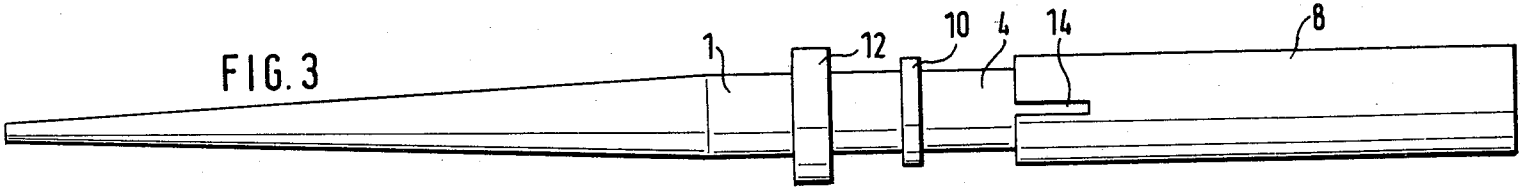

FIG. 3 a schematic side view of the device according to the invention.

In accordance with the embodiment shown in FIG. 1, the device according to the invention comprises an elongate body 1 one end of which is tapered, a passage 2 extending through said body. This passage 2 merges into a hollow barrel 4 formed at the other end of the body 1. The outside of said hollow barrel 4 is formed with abutments 10 and 13 which are shaped as annular projections. At its end opposite to the passage 2 the barrel 4 is enlarged to form an annular groove 9 into which a sealing element 7 of elastic material is inserted. The piston 5, which is slidable within the hollow barrel 4, is fitted through said sealing element 7. A sleeve 8 is integrally formed with the piston 5 and surrounds the same in central symmetrical relationship. The useful diameter of the sleeve is greater than, or equal to, the useful diameter of the projection 13. The bottom end of the sleeve 8 is formed with an inwardly directed projection 11, so that the axial movement of the sleeve 8 will be limited by the abutments 10 and 13. Within the sleeve, a spring 6 is pushed over the piston 5, which spring is supported by the bottom of the sleeve and by the end of the hollow barrel 4, or possibly by the sealing element 7. The upper portion 3 of the body 1 is further provided with a pair of wing-like handles 12 allowing one-hand operation of the dosing device. When liquid is to be drawn up, the open end of the passage 2 is dipped into the liquid, and the sleeve 8 together with the piston 5 are moved against the action of the spring 6 towards the abutment 10. When the sleeve is released, the sleeve together with the piston 5 will return into the starting position under the action of the spring, so that liquid will be drawn up through the passage 2. The amount that is drawn up is determined by the volume displaced upon movement of the piston, i.e., by the distance between the abutments 10 and 13, and by the diameter of the piston 5.

FIG. 2 shows a modified embodiment, in which relative to FIG. 1 the part comprising the piston 5 and the sleeve 8 is replaced by a different part, in which the piston 5 has reduced diameter. As compared to the previously described embodiment, a lesser volume will be displaced when the piston is advanced so that subsequently, when the sleeve returns to its initial position, a lesser quantity of liquid will be drawn up. The sealing element 7 placed in the annular groove 9 has such a degree of elasticity and is designed such that it will also sealingly engage a reduced thickness piston. Accordingly, it is possible with the device according to the invention to vary the dosage or metered quantity by replacement of the part formed of the sleeve 8 and the piston 5. FIG. 3 shows a side view of the device according to the invention. It will be apparent that that end of the sleeve 8 which is pushed over the hollow barrel 4 is formed with slots 14. Due to these slots 14 it is easily possible to turn the respective end of the sleeve 8 up, so that the inwardly directed annular projection 11 within the sleeve may be pushed over the corresponding projection 13 formed on the outside of the hollow barrel 4 (FIG. 1). Thus, the slots 14 also facilitate replacement of the part formed by the sleeve 8 and the piston 5, so that the metered quantity may readily be varied accordingly.

We claim:

1. A device for the contactless metering of liquids, comprising an elongate body having a longitudinal passage therethrough, an upper portion of the body forming a hollow barrel the interior of which forms an extension of said passage, a sleeve having an open lower end engaging the outer surface of said barrel, a piston centrally disposed within said sleeve and mounted for reciprocation inside said barrel, a spring surrounding said piston and bearing against an upper end of said barrel to bias said piston towards one limit position, and means providing a sealing between said upper barrel end and said piston.

2. The device of claim 1, wherein said piston and sleeve are integrally formed.

3. The device of claim 1, wherein at least one abutment limiting the downward movement of said sleeve is provided on the outer surface of said barrel.

4. The device of claim 3, wherein said abutment is in the form of an annular projection.

5. The device of claim 4, wherein said open lower sleeve end is provided with an inward projection having an inner diameter that is smaller than the outer diameter of said abutment.

6. The device of claim 1, wherein the upper end of said barrel is enlarged to form an annular groove into which said sealing means is fitted.

7. The device of claim 1, including two wing-like handles projecting outwardly from said body.

8. The device of claim 3, wherein the outer surface of said barrel is formed with a further annular projection for limitting the upward movement of said sleeve.

9. The device of claim 1, wherein the lower end of said sleeve is formed with two axially extending slots.

* * * * *